US008849137B2

(12) United States Patent
Furuya et al.

(10) Patent No.: US 8,849,137 B2
(45) Date of Patent: Sep. 30, 2014

(54) CONTROLLER, IMAGE FORMING APPARATUS, NON-TRANSITORY COMPUTER READABLE MEDIUM, AND IMAGE FORMING METHOD

(75) Inventors: Takao Furuya, Kanagawa (JP); Yoshinari Iwaki, Kanagawa (JP); Seigo Makida, Kanagawa (JP); Eizo Kurihara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 273 days.

(21) Appl. No.: 13/565,480

(22) Filed: Aug. 2, 2012

(65) Prior Publication Data

US 2013/0209116 A1 Aug. 15, 2013

(30) Foreign Application Priority Data

Feb. 15, 2012 (JP) ..... 2012-030369

(51) Int. Cl.
*G03G 15/00* (2006.01)

(52) U.S. Cl.
USPC ..... 399/49; 399/301

(58) Field of Classification Search
CPC ..... G03G 15/16; G03G 15/0194
USPC ..... 399/49, 301; 347/116
See application file for complete search history.

(56) References Cited

U.S. PATENT DOCUMENTS

| | | | | |
|---|---|---|---|---|
| 7,245,862 | B2 * | 7/2007 | Ebara | 399/301 |
| 7,352,978 | B2 * | 4/2008 | Ebara et al. | 399/49 |
| 8,369,756 | B2 * | 2/2013 | Kosako et al. | 399/301 |
| 8,521,046 | B2 * | 8/2013 | Sugiyama et al. | 399/49 |

FOREIGN PATENT DOCUMENTS

| | | |
|---|---|---|
| JP | A-2004-109517 | 4/2004 |
| JP | A-2004-219489 | 8/2004 |
| JP | A-2006-098712 | 4/2006 |
| JP | 2011209686 A * | 10/2011 |

* cited by examiner

*Primary Examiner* — Susan Lee
(74) *Attorney, Agent, or Firm* — Oliff PLC

(57) ABSTRACT

A controller includes a pattern forming unit that forms patterns multiple times on a first image holding member which is driven such that a surface thereof is circulated, a first detection unit that optically detects the patterns formed on the first image holding member by the pattern forming unit, a second detection unit that optically detects the patterns transferred from the first image holding member to a recording medium which is transported in a set transport direction, and an adjustment unit that adjusts a length in the transport direction of an image transferred to the recording medium on the basis of a time interval when the patterns are detected by the first detection unit and a time interval when the patterns are detected by the second detection unit.

10 Claims, 11 Drawing Sheets

CONTROLLER, IMAGE FORMING APPARATUS, NON-TRANSITORY COMPUTER READABLE MEDIUM, AND IMAGE FORMING METHOD

CROSS-REFERENCE TO RELATED APPLICATIONS

This application is based on and claims priority under 35 USC 119 from Japanese Patent Application No. 2012-030369 filed Feb. 15, 2012.

BACKGROUND (i) Technical Field

The present invention relates to a controller, an image forming apparatus, a non-transitory computer readable medium, and an image forming method.

(ii) Related Art

In an electrophotographic image forming apparatus, if a transport speed of a recording medium is changed, a position of an image transferred onto the recording medium is deviated from an original position. Therefore, there has been proposed a technique in which a transport speed of a recording medium is measured, and a transfer position or the like is adjusted based on the measurement result.

SUMMARY

According to an aspect of the invention, there is provided a controller including a pattern forming unit that forms patterns multiple times on a first image holding member which is driven such that a surface thereof is circulated; a first detection unit that optically detects the patterns formed on the first image holding member by the pattern forming unit; a second detection unit that optically detects the patterns transferred from the first image holding member to a recording medium which is transported in a set transport direction; and an adjustment unit that adjusts a length in the transport direction of an image transferred to the recording medium on the basis of a time interval when the patterns are detected by the first detection unit and a time interval when the patterns are detected by the second detection unit.

BRIEF DESCRIPTION OF THE DRAWINGS

Exemplary embodiments of the present invention will be described in detail based on the following figures, wherein.

DETAILED DESCRIPTION

Configuration of Exemplary Embodiment

Figure 1:
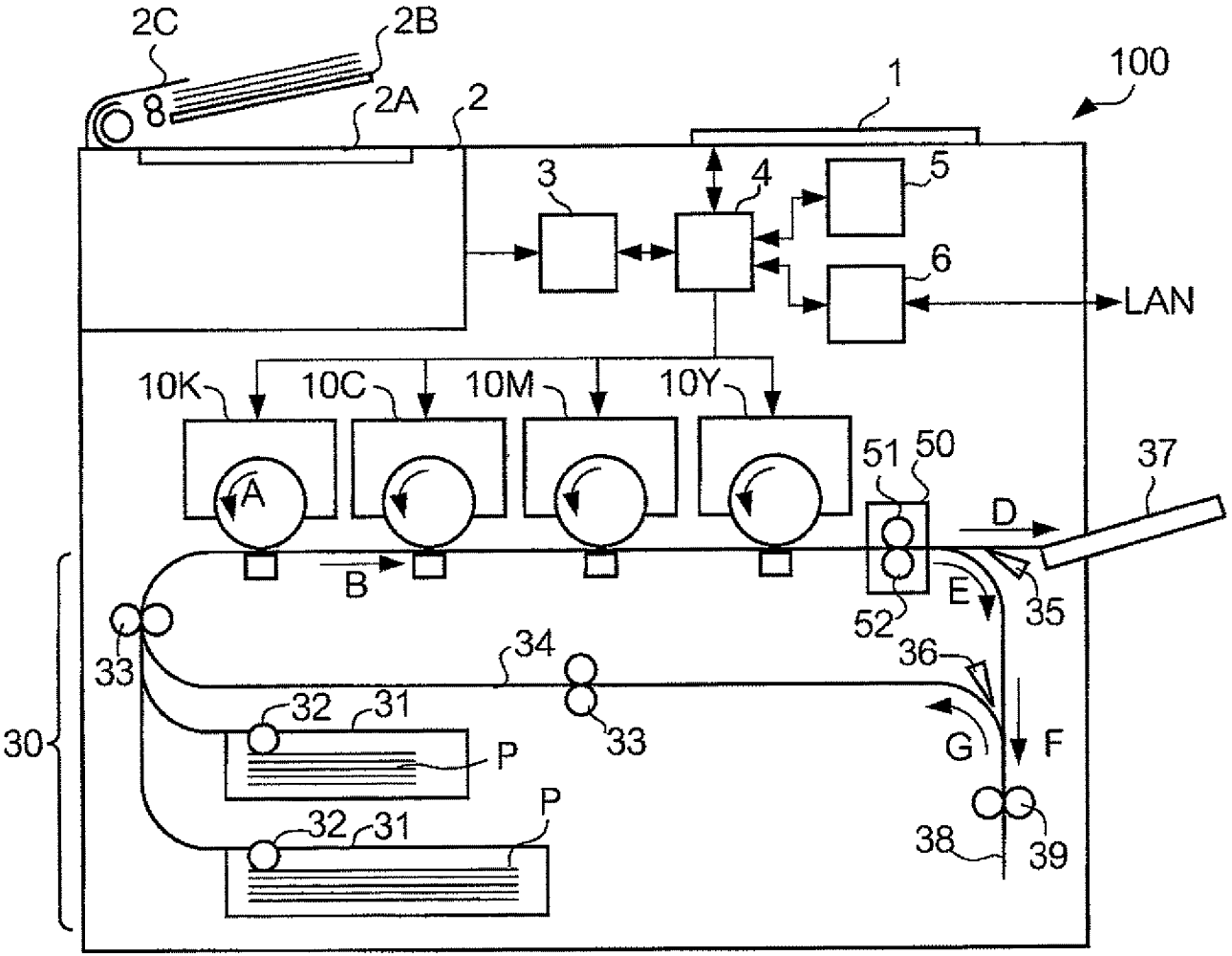
FIG. 1 is a diagram illustrating a hardware configuration of an image forming apparatus.
Figure 2:
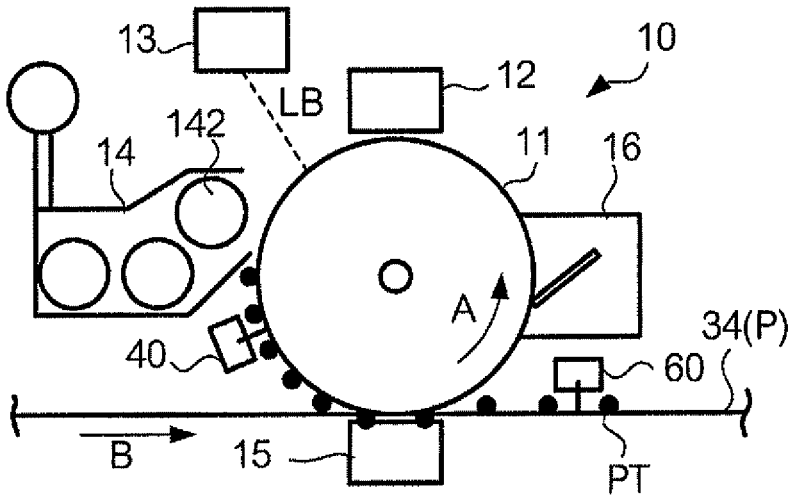
FIG. 2 is a diagram illustrating a configuration of an image forming unit.
Figure 3:
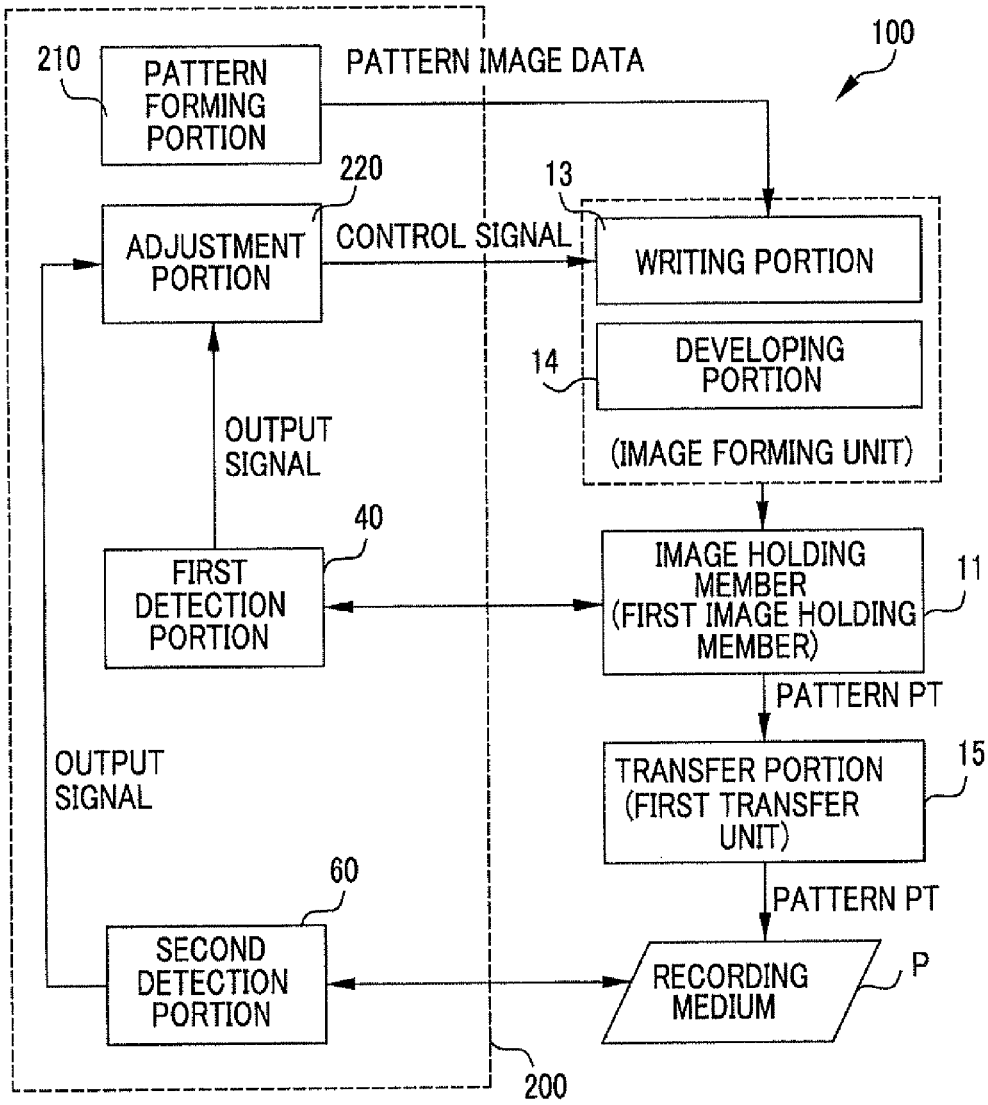
FIG. 3 is a block diagram illustrating a functional configuration of the image forming apparatus.

FIG. 1 is a diagram illustrating a hardware configuration of an image forming apparatus 100. FIG. 2 is a diagram where a configuration of an image forming unit 10 is viewed from the front side of the image forming apparatus 100. FIG. 3 is a block diagram illustrating a functional configuration of the image forming apparatus 100.

A controller 4 includes a CPU (Central Processing Unit) which is an arithmetic device, and a ROM (Read Only Memory) and a RAM (Random Access Memory) which are storage devices (neither shown). The ROM stores firmware in which procedures of activation of hardware or an OS (Operating System) are described. The RAM is used to store data when the CPU executes operations. A memory 5 is, for example, a hard disk drive, and stores the OS, application programs, and the like, and the respective portions of the image forming apparatus 100 are controlled by the controller 4 executing the programs.

An instruction receiving portion 1 includes various handlers for a user to input instructions into the image forming apparatus 100. An instruction received via the instruction receiving portion 1 is sent to the controller 4, and the controller 4 controls an operation of the image forming apparatus 100 in response to the instruction.

A communication portion 6 is a communication I/F (interface) and is connected to a LAN (Local Area Network) or the like (not shown) so as to relay communication between the image forming apparatus 100 and other devices.

A reading portion 2 optically reads an original document and thereby generates image data. Specifically, the reading portion 2 includes a light source, an optical system, and an imaging device (neither shown), wherein the light source irradiates an original document placed on a platen glass 2A with light, light reflected by the original document is decomposed into R (Red), G (Green) and B (Blue) via the optical system and is then incident to the imaging device. The imaging device converts the incident light into image data and supplies the image data to an image processing portion 3. In addition, the reading portion 2 includes a platen 2B on which an original document is placed, and an original document transport mechanism 2C which transports original documents placed on the platen 2B onto the platen glass 2A one by one.

The image processing portion 3 performs an image process for the image data. Specifically, the image processing portion 3 performs A/D conversion for the image data supplied from the reading portion 2, and performs noise removal, gamma correction, conversion of R, G and B into Y (Yellow), M (Magenta), C (Cyan), and K (Black), a screen process, and the like for the converted data. In addition, the image processing portion 3 performs the same image process for image data received from an external device by the communication portion 6. In this way, image data indicating grayscales of each pixel for each color is generated. The image processing portion 3 accumulates the image data which has undergone the image process in a buffer (not shown), and supplies the image data to the image forming unit 10 at set timing.

A transport portion 30 transports a recording medium P along a transport path 34 in a predetermined transport direction. Specifically, a medium accommodating portion 31 accommodates sheet-shaped recording media P such as paper in a state of being stacked, and when a feeding roller 32 is rotatably driven in synchronization with an operation of the image forming unit 10, the recording media P are fed to the transport path 34 one by one. A transport roller 33 provided on the transport path 34 is rotatably driven, and thereby the recording medium P is transported along the transport path 34 in the direction of the arrow B.

The image forming units 10Y, 10M, 10C and 10K form toner images of Y, M, C and K on the recording medium P in an overlapping manner using an electrophotographic method on the basis of the image data supplied from the image processing portion 3. Since configurations of the image forming units 10Y, 10M, 10C and 10K are the same, they are collectively referred to as the image forming unit 10 when differentiation therebetween is not necessary. In addition, in this case, notations of Y, M, C, and K are also omitted for constituent elements of the image forming unit 10.

The image forming unit 10 includes a charging portion 12, a writing portion 13, a developing portion 14, and a transfer portion 15, and the like which are provided around an image holding member 11.

The image holding member 11 is a roller which is rotatably driven in the direction of the arrow A by a motor (not shown), and a surface thereof is provided with a photosensitive layer made of semiconductors of which a potential varies depending on irradiation of light.

The charging portion 12 is, for example, a corotron type charging device, a roller type charging device, or the like, and charges the surface of the image holding member 11 to a predetermined potential.

The writing portion 13 writes a latent image into the image holding member 11 on the basis of image data. Specifically, the writing portion 13 generates light beams LB corresponding to grayscales of each pixel, indicated by the image data supplied from the image processing portion 3, and scans the surface of the image holding member 11 with the light beams LB in the main scanning direction (the axial direction of the image holding member 11). Then, in the surface of the image holding member 11, potentials of portions irradiated with the light beams LB are reduced, thereby generating a latent image. The image holding member 11 is rotatably driven, and thereby writing of a latent image with the scanning line units in the main scanning direction is repeatedly performed in the sub-scanning direction (circumferential direction of the image holding member 11).

The developing portion 14 develops the latent image written in the image holding member 11. Specifically, a two-component developer including toner and carrier is accommodated in the developing portion 14. The toner is obtained by coloring powder made of resin with a color material of any one of Y, M, C, and K, and the developing portions 14Y, 14M, 14C and 14K respectively accommodate toners of Y, M, C, and K. The carrier is powder made of a magnetic material. A developing roller 142 is provided such that outer circumferential surfaces are opposite to each other with the image holding member 11. The two-component developer is attached to the outer circumferential surface of the developing roller 142 which is rotatably driven. A developing bias voltage which has a polarity reverse to that of the latent image is applied to the developing roller 142, the toner is charged to the polarity reverse to that of the latent image by the developing bias voltage, and, as a result, the toner is transmitted onto the latent image by electrostatic attraction. The latent image is developed by the toner in this way, and thus a toner image is formed on the image holding member 11.

The transfer portion 15 is, for example, a corotron type charging device, a roller type charging device, or the like, and is provided at a position opposite to the image holding member 11 with the transport path 34 interposed therebetween. A transfer bias voltage with a polarity reverse to that of the toner image is applied to the transfer portion 15, the recording medium P is charged to the polarity reverse to that of the toner image by the transfer bias voltage, and, as a result, the toner image is transferred onto the recording medium P.

A fixing portion 50 includes a heating member 51 which has a heat source and a pressing member 52 which is pressed toward the heating member, and melts and presses the toner image with the medium P interposed between the heating member 51 and the pressing member 52, thereby fixing the toner image on the medium P.

Figure 4:
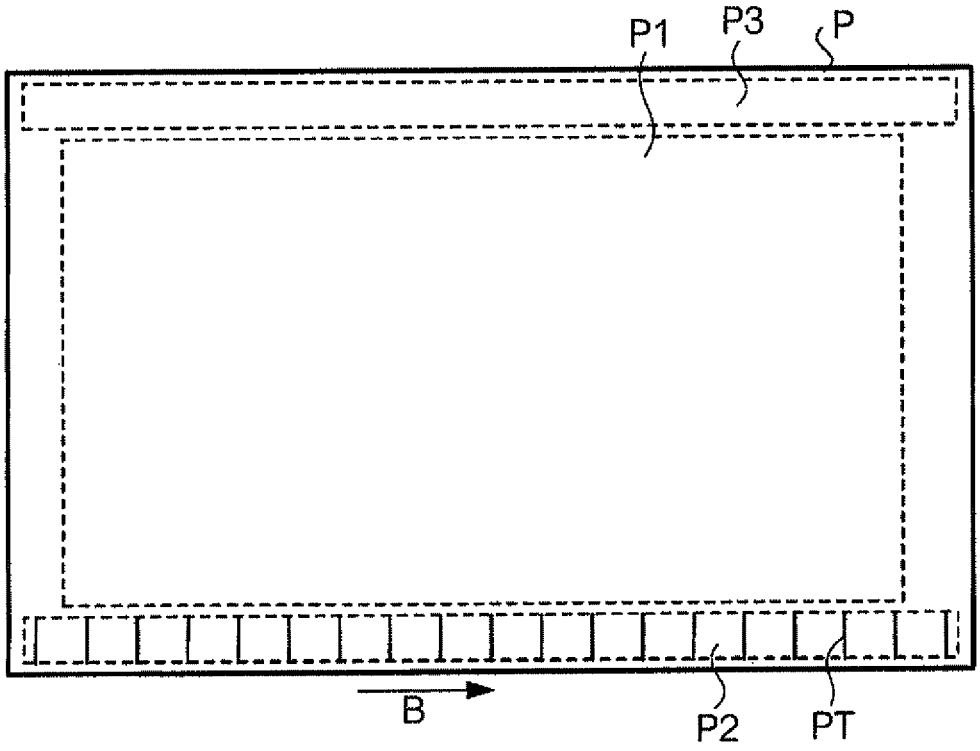
FIG. 4 is a diagram illustrating patterns formed on a recording medium.

FIG. 4 is a diagram illustrating patterns PT formed on the recording medium P. The patterns PT are images which are repeatedly formed in the transport direction of the recording medium P. The patterns PT in the exemplary embodiment are line segments which extend in a direction crossing the transport path 34, but the patterns PT may have any shape. The controller 4 supplies pattern image data which is image data indicating the patterns PT to the writing portion 13. Then, the writing portion 13 writes a latent image onto the image holding member 11 on the basis of the pattern image data, and the developing portion 14 develops the latent image so as to generate a toner image. In the pattern image data, a distance between two patterns PT adjacent to each other is constant. Therefore, the writing portion 13 writes latent images indicating the patterns PT onto the image holding member 11 for each set time, and since the image holding member 11 is rotatably driven in the arrow A direction, plural patterns PT are formed with an interval therebetween by a distance according to a rotation speed of the image holding member 11.

In forming an image based on image data which is generated by the reading portion 2 reading an original document or image data which is received from an external device by the communication portion 6, an image is not formed in an image non-formation region which has a specific width along the edges of the recording medium P, but an image is formed in an image formation region P1 which is located further inside than the image non-formation region. In the exemplary embodiment, the patterns PT are formed in the image non-formation region P2 or P3 which extends in the transport direction (the arrow B direction) of the recording medium P.

A first detection portion 40 is provided so as to be opposite to the image holding member 11 between a position where a latent image is developed on the image holding member 11 by the developing portion 14 and a position where a toner image on the image holding member 11 is transferred onto the recording medium P by the transfer portion 15.

A second detection portion 60 is an example of the second detection unit according to an exemplary embodiment of the invention. The second detection unit optically detects a pattern which has been transferred onto the recording medium by a first transfer unit (the transfer portion 15). The second detection portion 60 is provided so as to be opposite to the recording medium P further downstream than the position where a toner image on the image holding member 11 is transferred onto the recording medium P by the transfer portion 15.

The first detection portion 40 and the second detection portion 60 have the same configuration, and, here, the second detection portion 60 will be described.

Figure 5:
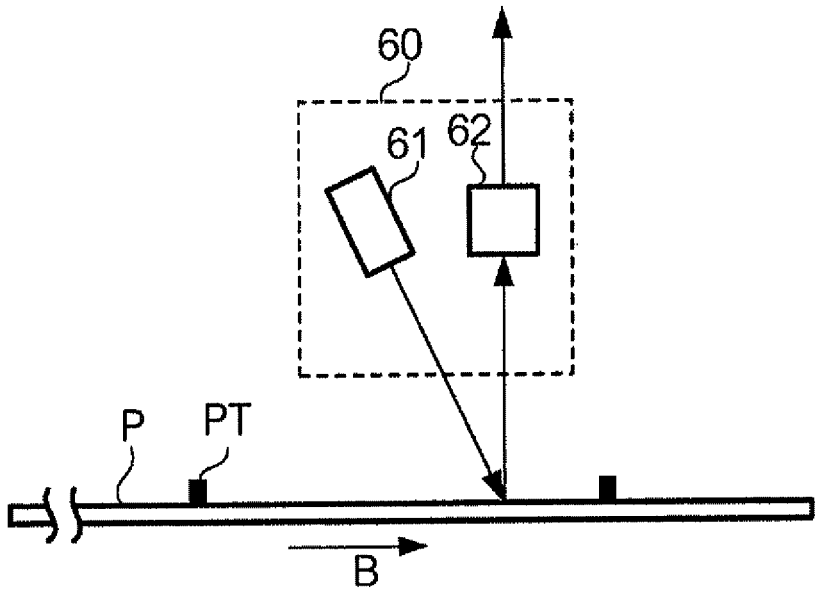
FIG. 5 is a diagram illustrating a configuration of a second detection portion.

FIG. 5 is a diagram illustrating a configuration of the second detection portion 60. The second detection portion 60 is an optical sensor which includes a light emitting element 61 and a light receiving element 62. The light emitting element 61 is, for example, a light emitting diode, and has a peak wavelength in a wavelength region of light which is absorbed by the toner accommodated in the developing portion 14. The light receiving element 62 is, for example, a photodiode, detects light of the wavelength region including the peak wavelength of the light emitting element 61, and outputs a signal corresponding to an intensity of the detected light. The controller 4 receives the signal from the light receiving element 62 and detects the patterns PT on the basis of the signal. Since the patterns PT absorb light of a specific wavelength region corresponding to the toner accommodated in the developing portion 14, an intensity of reflected light is different in the region in which the patterns PT are formed and in the region in which the patterns PT are not formed on the image holding member 11 and the recording medium P, and a signal output by the light receiving element 62 indicates a value corresponding to the intensity of the reflected light. Therefore, a threshold value is set between a value of a signal for the region in which the patterns PT are formed and a value of a signal for the region in which the patterns PT are not formed. The controller 4 determines that the patterns PT are detected if a value of a signal output from the light receiving element 62 is smaller than the threshold value.

The first detection portion 40 also includes a light emitting element 41 (not shown) which is the same as the light emitting element 61, and a light receiving element 42 (not shown) which is the same as the light receiving element 62.

Operation in Exemplary Embodiment

Figure 6:
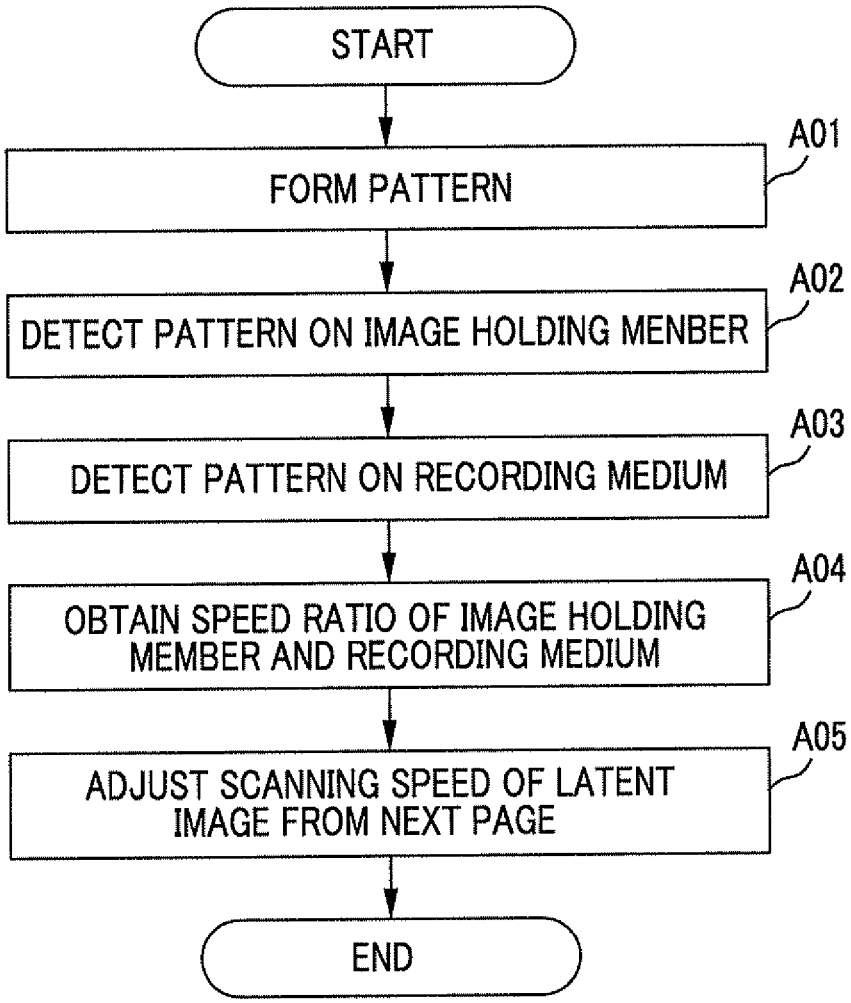
FIG. 6 is a flowchart illustrating an operation in an exemplary embodiment.

FIG. 6 is a flowchart illustrating an operation in an exemplary embodiment. The controller 4 performs image length adjustment described below according to the program stored in the memory 5.

Here, the meaning of the image length adjustment will be described. There are cases where a transport speed of a recording medium is changed in the electrophotographic image forming apparatus. As causes thereof, there may be various causes such as, for example, frictional resistance when the recording medium is transported becoming different depending on the kind of paper used as the recording medium or an image density, and, if the transport speed of the recording medium is changed, the relative speed between the surface of the image holding member and the surface of the recording medium is also changed, and thus a length in the recording medium transport direction of a toner image transferred onto the recording medium is changed. For example, assuming that a movement speed of the surface of the image holding member is constant, in a case where the transport speed of the recording medium is increased, a toner image transferred to the recording medium is enlarged in the recording medium transport direction as compared with a case before the transport speed is increased. Conversely, in a case where a transport speed of the recording medium is decreased, a toner image transferred to the recording medium is reduced in the recording medium transport direction as compared with a case before the transport speed is decreased. In order to suppress the change in the length of the toner image, in the exemplary embodiment, the image length adjustment described below is performed.

The image length adjustment may be performed at any moment. For example, the image length adjustment may be performed when the reading portion 2 reads an original document, or image data is received by the communication portion 6. In addition, the controller 4 may calculate an average value of an image density indicated by image data used to form images, and the controller 4 may determine necessity and unnecessity of the image length adjustment on the basis of the average value, or a device measuring temperature or humidity in the inside of the image forming apparatus 100 may be provided, and the controller 4 may determine necessity and unnecessity of the image length adjustment on the basis of the measured temperature or humidity. In this case, for example, relationships between an image density, temperature, and humidity and a transport speed of a recording medium may be examined through tests, an image density, temperature, and humidity where cause considerable changes in a transport speed may be set as threshold values, and the controller 4 may determine necessity and unnecessity of the image length adjustment on the basis of the threshold values. In addition, the image length adjustment may be performed when a user inputs an image length adjustment instruction into the instruction receiving portion 1. For example, since there is a concern that a transport speed may be changed when paper with the thickness different from that of typical paper is used as the recording medium P, in this case, a user may input an image length adjustment instruction.

In addition, in the exemplary embodiment, the image forming apparatus 100 includes four image forming units 10, and the controller 4 performs the image length adjustment for each image forming unit 10. A process of the image length adjustment in each image forming unit 10 is the same. FIG. 6 shows procedures of the image length adjustment in one of the four image forming units 10.

If the time comes when the image length adjustment is performed, the controller 4 performs processes shown in FIG. 6.

In step A01, a pattern forming portion 210 forms patterns PT on the image holding member 11. Specifically, the controller 4 causes the transport portion 30 to start transporting the recording medium P so as to supply pattern image data corresponding to one page of the recording medium P to the writing portion 13. Then, the writing portion 13 writes a latent image onto the image holding member 11 on the basis of the pattern image data, and the developing portion 14 develops the latent image, thereby forming the patterns PT on the image holding member 11. The image holding member 11 is rotatably driven in the arrow A direction, and thus the formed patterns PT are also moved in the arrow A direction. In addition, in the exemplary embodiment, in a case where the image length adjustment is performed, the patterns PT are formed on the first recording medium P, image formation is not performed for the first recording medium P on the basis of image data generated by the reading portion 2 reading an original document or image data received by the communication portion 6, and image formation based on the image data is performed for the second and following recording media P transported subsequent to the first recording medium P. In the image formation for the second and following recording media P, the image length adjustment is performed based on a detection result of the patterns PT formed on the first recording medium P.

In step A02, the first detection portion 40 detects the patterns PT on the image holding member 11. Specifically, if a value of a signal output from the first detection portion is smaller than a threshold value, the controller 4 determines that the patterns PT pass through the detection position of the first detection portion 40. Since plural patterns PT are formed on the image holding member 11 in the sub-scanning direction, the patterns PT are detected multiple times at a specific interval.

In step A03, the second detection portion 60 detects the patterns PT on the recording medium P. Specifically, if a value of a signal output from the second detection portion 60 is smaller than a threshold value, the controller 4 determines that the patterns PT pass through the detection position of the second detection portion 60. Since plural patterns PT are formed on the recording medium P in the transport direction, the patterns PT are detected multiple times at a specific interval.

In step A04, an adjustment portion 220 obtains a ratio of a time interval when the patterns PT are detected by the first detection portion 40 and a time interval when the patterns PT are detected by the second detection portion 60. Specifically, the controller 4 measures time required from detection of the first pattern PT to detection of the last pattern PT by the first detection portion 40. For example, since the number of the patterns PT corresponding to one page is known, when detecting the first pattern PT, the controller 4 starts counting the number of clocks, also starts measuring the number of the detected patterns PT, and finishes counting the number of clocks when the number of the patterns PT corresponding to one page is detected. The controller 4 counts the number of clocks in the second detection portion 60 in the same manner. In addition, the controller 4 obtains a ratio of the number of clocks in the second detection portion 60 to the number of clocks in the first detection portion 40. This ratio indicates a speed ratio of a movement speed of the surface of the image holding member 11 and a transport speed of the recording medium P. For example, if the number of clocks in the first detection portion 40 is 100, and the number of clocks in the second detection portion 60 is 120, the speed ratio is 1.2.

In step A05, the adjustment portion 220 adjusts a length in the recording medium transport direction of a toner image transferred to the second and following recording media P on the basis of the speed ratio obtained in step A04. In this example, since the speed ratio is 1.2, when the length in the sub-scanning direction of a toner image formed on the image holding member 11 is L, if the image length adjustment is not performed, the length in the recording medium transport direction of the toner image transferred to the recording medium P becomes 1.2 L. In the exemplary embodiment, by adjusting timing when the writing portion 13 writes a latent image, the length of a toner image transferred to the recording medium P is adjusted. Specifically, when the surface of the image holding member 11 is scanned with the light beams LB, the controller 4 outputs a control signal to the writing portion so as to perform the scanning at a speed obtained by multiplying a speed set as an initial value by the speed ratio obtained in step A04. In this example, the scanning is performed at a speed which is 1.2 times the initial value. As a result, the length in the sub-scanning direction of a latent image written on and a toner image formed on the image holding member 11 becomes L/1.2, and thus the length in the recording medium transport direction of the toner image transferred onto the recording medium P becomes L.

In addition, the operation described here is an operation performed by one of the four image forming units 10. In the respective image forming units 10, the patterns PT are formed using toners of different colors, and the patterns PT of the respective colors are formed so as not to overlap each other, that is, such that positions of the patterns PT of the respective colors are misaligned in the main scanning direction or the sub-scanning direction.

The above description corresponds to an operation in the exemplary embodiment.

If the patterns PT are detected on places other than the recording medium P instead of the recording medium P, for example, on the transport belt which sucks and transports the recording medium P and the patterns PT are transferred onto, there are cases where a speed ratio of the image holding member 11 and the recording medium P may not be obtained accurately. This is because there are cases where sliding occurs between the transport belt and the recording medium P. As such, in a case where the image length adjustment is performed based on the speed ratio including errors, the length of an image after being adjusted also includes errors caused by the errors of the speed ratio. In contrast, in the exemplary embodiment, since the patterns PT formed on the image holding member 11 are transferred onto the recording medium P, and the image length adjustment is performed based on a time interval when the patterns PT are detected on the image holding member 11 and a time interval when the patterns PT are detected on the recording medium P, the image length adjustment can be performed without being influenced by errors of a speed ratio of the image holding member 11 and the recording medium P.

MODIFIED EXAMPLES

The above-described exemplary embodiment may be modified as in modified examples described below. In addition, the exemplary embodiment and the modified examples may be combined with each other. Further, plural modified examples may be combined with each other.

Modified Example 1

In the exemplary embodiment, an example has been described where the adjustment portion 220 obtains a speed ratio by measuring time required from detection of the first pattern PT formed on the recording medium P to detection of the last pattern PT. In other words, in the exemplary embodiment, an average speed ratio for a sheet of the recording medium P is obtained. In contrast, the adjustment portion 220 may divide a sheet of the recording medium P into plural sections in the transport direction and perform the image length adjustment for each section by obtaining a speed ratio for each section. For example, assuming that a sheet of the recording medium P is divided into three sections in the transport direction, and ten patterns PT are formed in each section, the controller 4 measures time required from detection of the first pattern PT to detection of the tenth pattern PT, time required from detection of the eleventh pattern PT to detection of the twentieth pattern PT, and time required from detection of the twenty-first pattern. PT to detection of the thirtieth pattern PT on the image holding member 11 and the recording medium P, and obtains a speed ratio of the image holding member 11 and the recording medium P for each section. The controller 4 stores the speed ratio in the RAM in correlation with the sections, reads the speed ratio from the RAM when images are formed on the second and following recording media P, and performs the image length adjustment for each section on the basis of the speed ratio using the same method as in the exemplary embodiment.

In short, the adjustment portion according to the modified example is an example of the adjustment unit which adjusts a length based on a time interval when the patterns are detected by the first detection unit and a time interval when the patterns are detected by the second detection unit at a section on the first image holding member corresponding to a section on the recording medium in the transport direction for each section.

The meaning of performing the image length adjustment for each section is as follows. There are cases where a transport speed is changed while a sheet of the recording medium P passes through a position where a toner image is transferred by the transfer portion 15. For example, in a case of using the recording medium P thicker than a typical copy paper sheet, resistance when the front end of the recording medium P enters between the image holding member 11 and the transfer portion 15 may become larger than in the typical copy paper sheet. Alternatively, while the recording medium P passes through the curved section of the transport path 34, the recording medium P may be wound. In addition, in a case where the transport portion 30 has a transport belt which sucks and transports the recording medium P, the recording medium P may be peeled off from the transport belt when the recording medium P passes through the curved section of the transport path 34. These factors are only an example; however, there is a concern that a transport speed may be changed after the front end of the recording medium P passes through a transfer position until the rear end thereof passes through the transfer position. In this case, even if the image length adjustment is performed based on an average speed ratio in a sheet of the recording medium P in the same manner as the exemplary embodiment, there is a concern that the change in the length of a toner image may not be removed. Therefore, in the modified example, a sheet of the recording medium P is divided into plural sections in the transport direction, a transport speed is obtained for each section, and the image length adjustment is performed for each section. With this configuration, even if a transport speed is changed while a sheet of the recording medium P passes through the transfer position, a change in the length of a toner image in the transport direction is suppressed.

Modified Example 2

Although an example where a toner image formed on the image holding member 11 is directly transferred onto the recording medium P has been described, the invention may be employed to a configuration in which the toner image formed on the image holding member 11 is transferred onto another image holding member, and the transferred toner image is transferred onto the recording medium P. Differences between the modified example and the exemplary embodiment are as follows.

Figure 7:
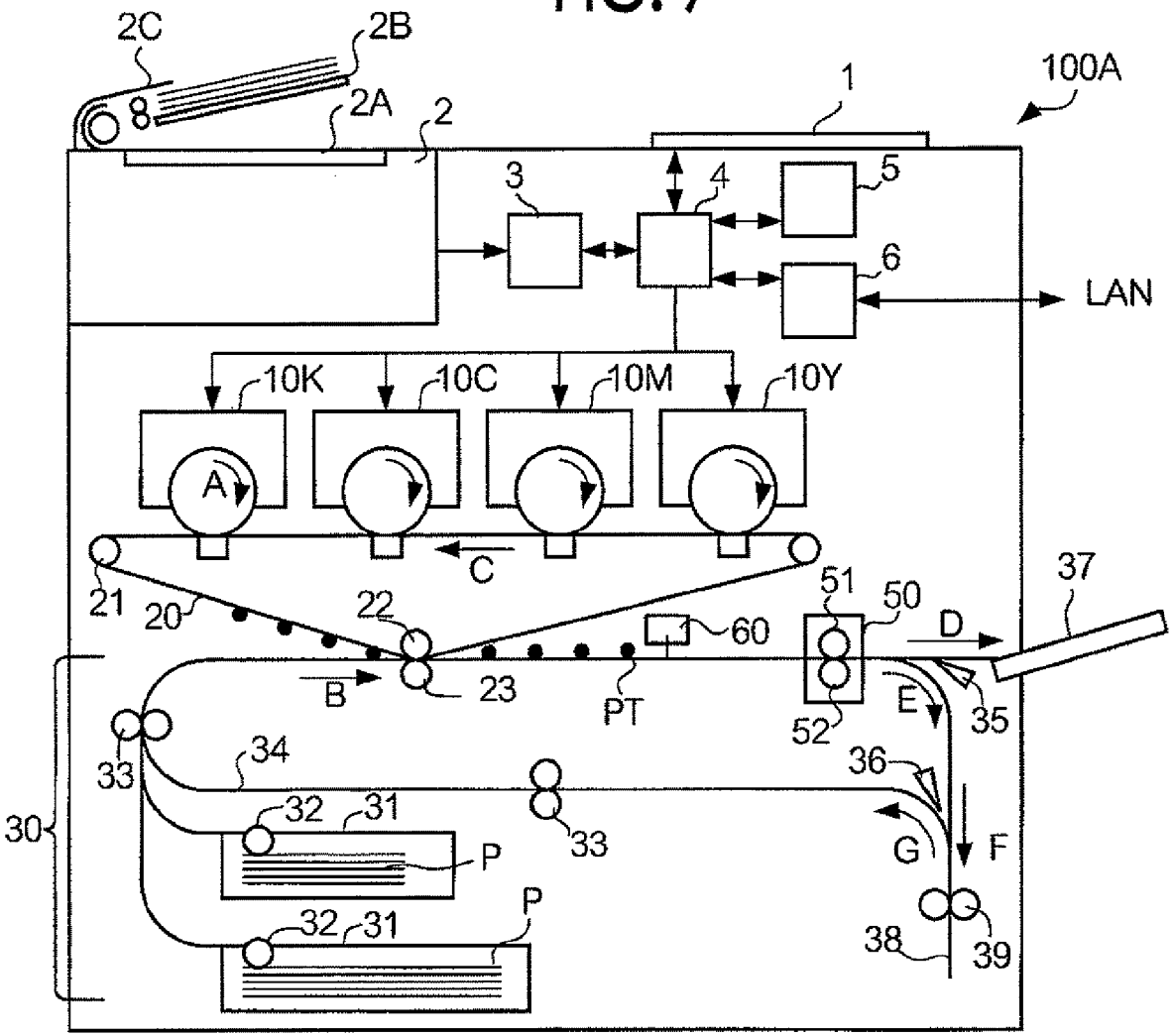
FIG. 7 is a diagram illustrating a hardware configuration of an image forming apparatus.
Figure 8:
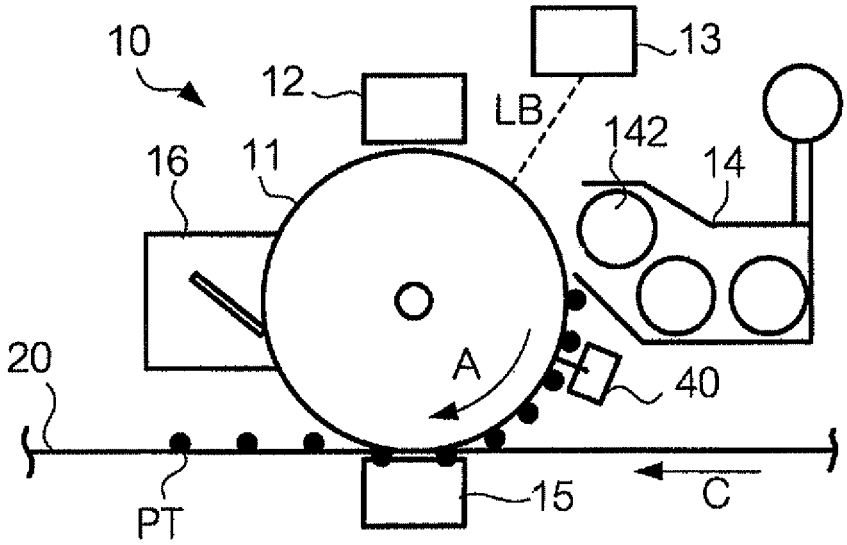
FIG. 8 is a diagram illustrating a position of a first sensor.
Figure 9:
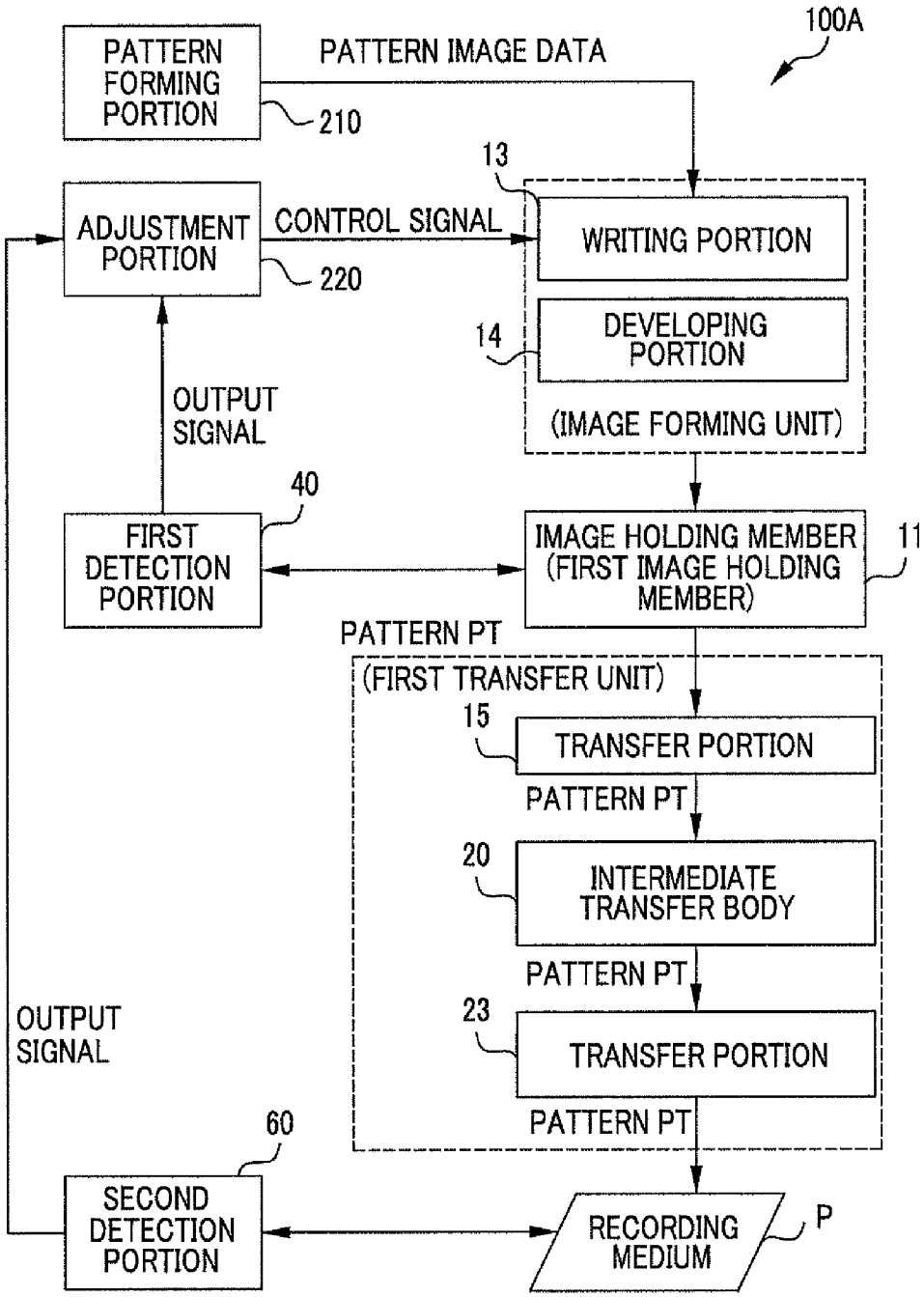
FIG. 9 is a block diagram illustrating a functional configuration of the image forming apparatus.

FIG. 7 is a diagram illustrating a hardware configuration of an image forming apparatus 100A. FIG. 8 is a diagram illustrating a position of the first sensor 40. FIG. 9 is a block diagram illustrating a functional configuration of the image forming apparatus 100A. The same constituent elements as those of the image forming apparatus 100 of the exemplary embodiment are given the same reference numerals. The image forming unit 10 is provided such that a rotation direction of the image holding member 11 is reverse to that in the exemplary embodiment.

The image holding member 11 is an example of the first image holding member according to the modified example of the invention. The writing portion 13 and the developing portion 14 are an example of the image forming unit according to the modified example of the invention. The transfer portion 15, an intermediate transfer body 20, and a transfer portion 23 are an example of the first transfer unit according to the modified example of the invention.

The intermediate transfer body 20 is an endless belt which hangs over a driving roller 21, a roller 22, and the like and rotates, and the intermediate transfer body 20 is circulated in the arrow C direction when the driving roller 21 is rotatably driven. The transfer portion 15 is provided at a position which is opposite to the image holding member with the intermediate transfer body 20 interposed therebetween. A transfer bias voltage with a polarity reverse to that of a toner image on the image holding member 11 is applied to the transfer portion 15, the intermediate transfer body 20 is charged to a polarity reverse to that of the toner image, and, as a result, the toner image is transferred onto the intermediate transfer body 20 by electrostatic attraction. This transfer operation is referred to as a primary transfer.

The transfer portion 23 is, for example, a roller type charging device, and is provided at a position which is opposite to the roller 22 with the transport path 34 and the intermediate transfer body 20 interposed therebetween. A transfer bias voltage with a polarity reverse to that of a toner image on the intermediate transfer body 20 is applied to the transfer portion 23, the recording medium P is charged to a polarity reverse to that of the toner image, and, as a result, the toner image is transferred onto the recording medium P by electrostatic attraction. This transfer operation is referred to as a secondary transfer.

The first detection portion 40 is provided so as to be opposite to the image holding member 11 between a position where a latent image is developed on the image holding member 11 by the developing portion 14 and a position where the toner image on the image holding member 11 is transferred onto the recording medium P by the transfer portion 15.

The second detection portion 60 is provided so as to be opposite to the recording medium P further downstream than a position where a toner image on the intermediate transfer body 20 is transferred onto the recording medium P by the transfer portion 23. In addition, although a single second detection portion 60 is shown for convenience, in practice, a total of four second detection portions 60 corresponding to toners used in the respective image forming units 10 are provided.

Processes regarding the image length adjustment are the same as in the exemplary embodiment.

Modified Example 3

In the image forming apparatus 100A described in the modified example 2, the first detection portion 40 may detect the pattern PT on the intermediate transfer body 20.

Figure 10:
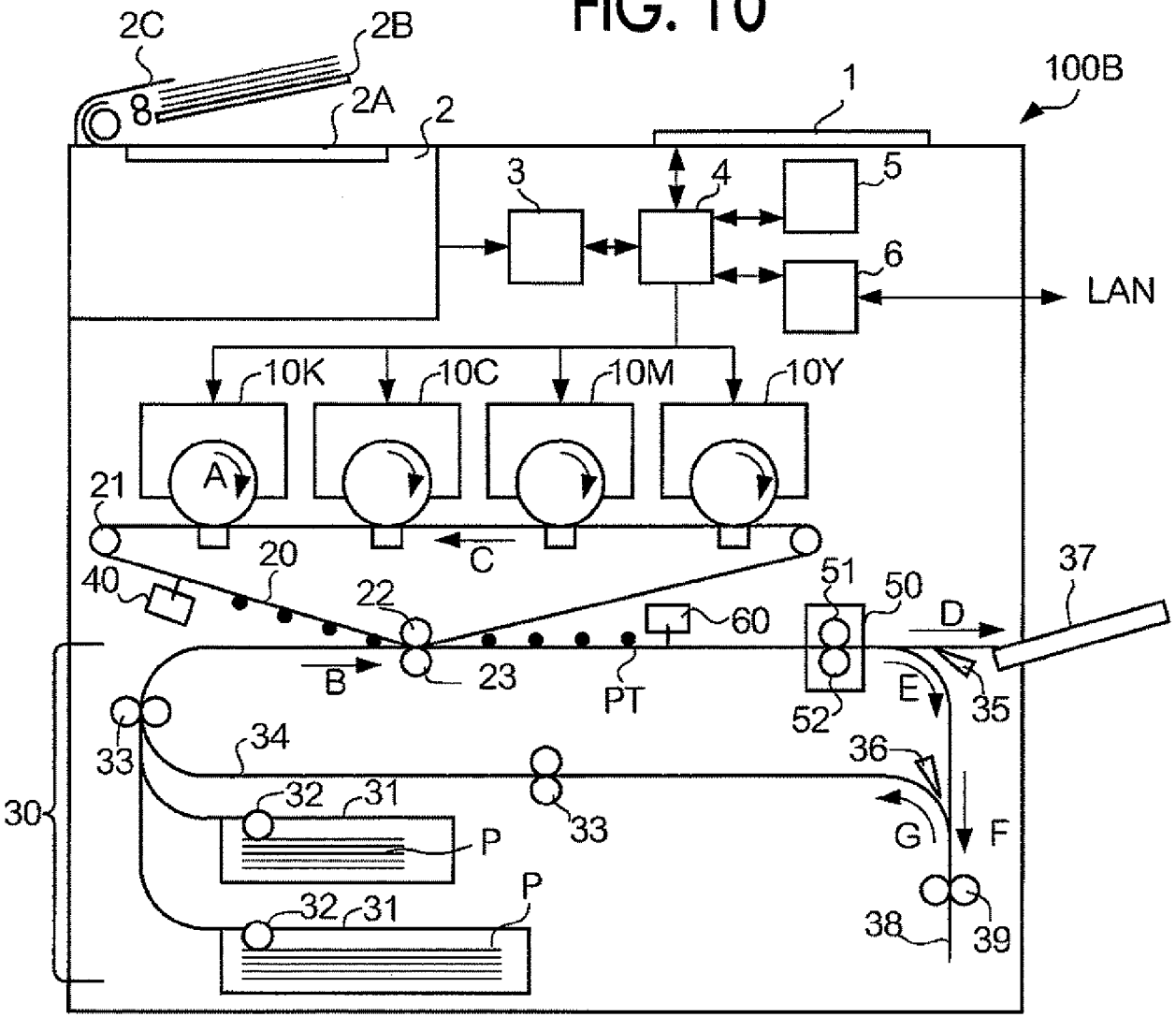
FIG. 10 is a diagram illustrating a hardware configuration of an image forming apparatus.
Figure 11:
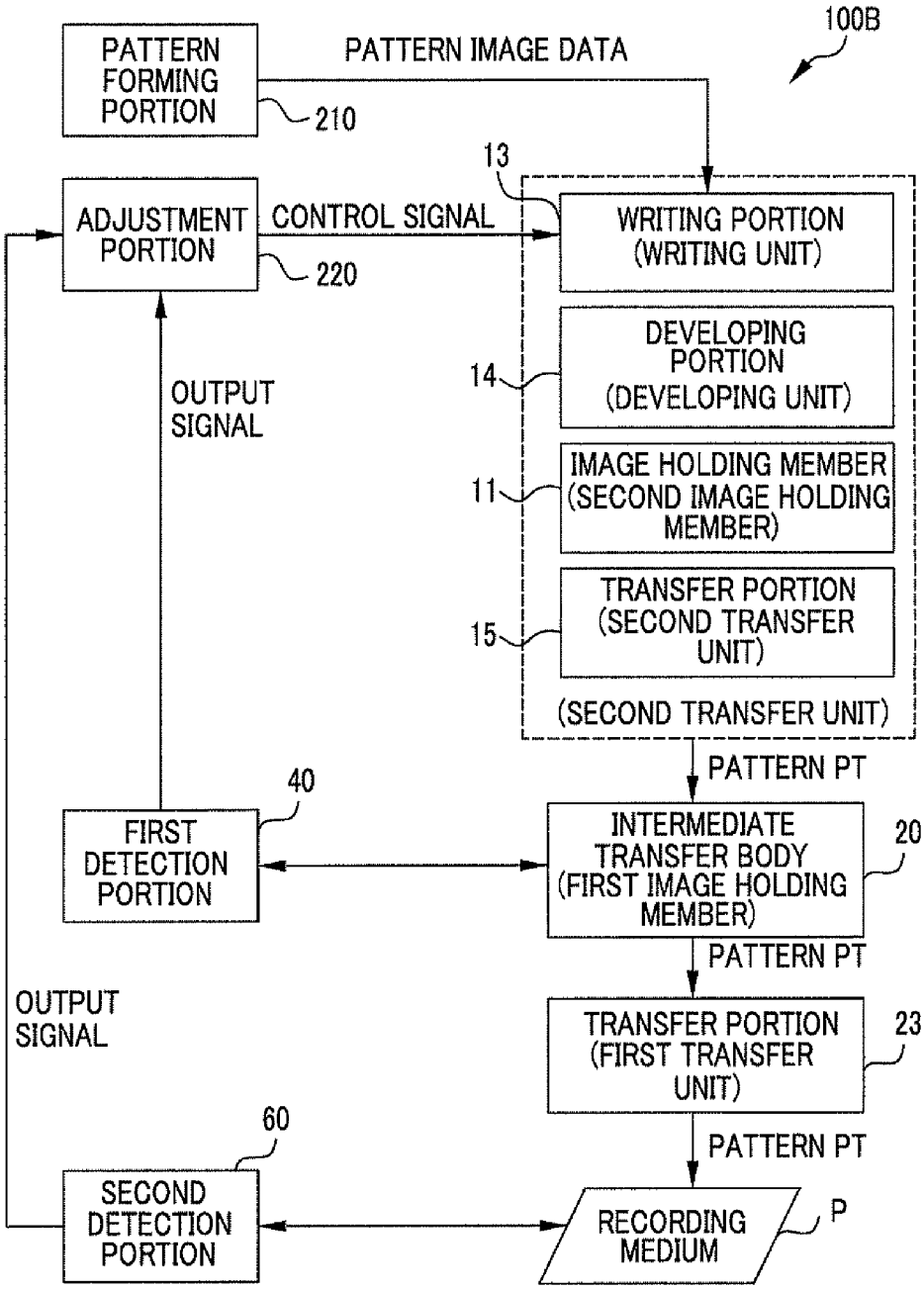
FIG. 11 is a block diagram illustrating a functional configuration of the image forming apparatus.

FIG. 10 is a diagram illustrating a hardware configuration of the image forming apparatus 100B. FIG. 11 is a block diagram illustrating a functional configuration of an image forming apparatus 100B. In the modified example, the first detection portion 40 is provided so as to be opposite to the intermediate transfer body 20 between a position where a toner image on the image holding member 11 is transferred onto the intermediate transfer body 20 by the transfer portion 15 on the most downstream side and a position where a toner image on the intermediate transfer body 20 is transferred onto the recording medium P by the transfer portion 23.

The image holding member 11 is an example of the second image holding member according to the modified example of the invention. The writing portion 13 is an example of the writing unit according to the modified example of the invention. The developing portion 14 is an example of the developing unit according to the modified example of the invention. The transfer portion 15 is an example of the second transfer unit according to the modified example of the invention. In addition, the image holding member 11, the writing portion 13, the developing portion 14, and the transfer portion 15 are an example of the image forming unit according to the modified example of the invention. The intermediate transfer body 20 is an example of the first image holding member according to the modified example of the invention. The transfer portion 23 is an example of the first transfer unit according to the modified example of the invention.

In the modified example, the first detection portion 40 is configured to detect the pattern PT not on the image holding member 11 but on the intermediate transfer body 20. The reason for such a configuration is that because the constituent elements such as the charging portion 12, the writing portion 13, and the developing portion 14 are provided around the image holding member 11, there are cases that a space for providing the first detection portion 40 between a development position of the developing portion 14 and a transfer position of the transfer portion 15 is insufficient. In addition, if a space for providing the first detection portion 40 at such a position is to be secured, there is a concern that there may be a difficulty in minimizing the image forming apparatus due to changes in positions of other constituent elements. In contrast, there are many cases where a space for providing the first detection portion 40 is easily secured at a location further upstream side than the transfer portion 23 of the intermediate transfer body 20 as compared with the location between the development position of the developing portion 14 and the transfer position of the transfer portion 15. Therefore, in a case where the first detection portion 40 may not be provided between the development position of the developing portion 14 and the transfer position of the transfer portion 15, the first detection portion 40 may be provided so as to be opposite to the intermediate transfer body 20 between a position where a toner image on the image holding member 11 is transferred onto the intermediate transfer body 20 by the transfer portion 15 on the most downstream side and a position where a toner image on the intermediate transfer body 20 is transferred onto the recording medium P by the transfer portion 23.

In addition, although the first detection portion 40 and the second detection portion 60 are respectively shown singly for convenience, in practice, four first detection portions 40 and four second detection portions 60 corresponding to toners used in the respective image forming units 10 are provided.

Modified Example 4

In the image length adjustment, instead of adjusting a scanning speed of the writing portion 13, a transport speed of the recording medium P may be adjusted. For example, in the same manner as the exemplary embodiment, it is assumed that when the length in the sub-scanning direction of a toner image formed on the image holding member 11 is L, a speed ratio before the image length adjustment is performed is 1.2. In this case, if a rotation speed of the transport roller 33 is controlled such that a transport speed of the recording medium P becomes 1/1.2, although the length in the sub-scanning direction of a latent image and a toner image on the image holding member 11 does not vary, a transport speed of the recording medium P becomes 1/1.2, and thus the length in the recording medium transport direction of a toner image transferred onto the recording medium P becomes 1/1.2 of the length before the image length adjustment is performed, that is, becomes L.

Modified Example 5

The pattern PT may be formed in an image formation region P1.

The pattern PT may be made of a material which absorbs light in an invisible range. For example, an inkjet type head ejecting a material which absorbs infrared rays is provided so as to be opposite to the image holding member 11, and sensors which detect infrared rays are provided as the first detection portion 40 and the second detection portion 60. In this case, not only the patterns PT but also an image based on image data generated by the reading portion 2 reading an original document or image data received by the communication portion 6 may be formed on the first recording medium P.

Modified Example 6

The image holding member 11 may be driven such that an endless belt provided with a photosensitive layer on its outer circumferential surface is hung on plural roller and is rotated for circulation of the belt surface.

The intermediate transfer body 20 may be a cylindrical body which is rotatably driven.

Modified Example 7

The invention may be specified as a controller for controlling the image forming apparatus. A controller 200 shown in FIG. 3 is an example of the controller according to an exemplary embodiment of the invention, and includes the pattern forming portion 210, the adjustment portion 220, the first detection portion 40, and the second detection portion 60. In other words, the controller includes a pattern forming unit that forms patterns multiple times on a first image holding member which is driven such that a surface thereof is circulated; a first detection unit that optically detects the patterns formed on the first image holding member by the pattern forming unit; a second detection unit that optically detects the patterns transferred from the first image holding member to a recording medium which is transported in a set transport direction; and an adjustment unit that adjusts a length in the transport direction of an image transferred to the recording medium on the basis of a time interval when the patterns are detected by the first detection unit and a time interval when the patterns are detected by the second detection unit.

Modified Example 8

Although an example where the processes are performed by the controller 4 executing a program has been described in the exemplary embodiment, the same function may be mounted in hardware. In addition, the program may be recorded on a non-transitory computer readable medium such as an optical recording medium or a semiconductor memory so as to be provided, and the program may be read from the recording medium so as to be stored in the memory 5 of the image forming apparatus 100. Further, the program may be provided via an electrical communication line.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A controller comprising:

a pattern forming unit that forms patterns multiple times on a first image holding member which is driven such that a surface thereof is circulated;

a first detection unit that optically detects the patterns formed on the first image holding member by the pattern forming unit;

a second detection unit that optically detects the patterns transferred from the first image holding member to a recording medium which is transported in a set transport direction; and an adjustment unit that adjusts a length in the transport direction of an image transferred to the recording medium on the basis of a time interval when the patterns are detected by the first detection unit and a time interval when the patterns are detected by the second detection unit.

2. The controller according to claim 1, wherein the adjustment unit adjusts the length on the basis of a time interval when the patterns are detected by the first detection unit and a time interval when the patterns are detected by the second detection unit at a section on the first image holding member corresponding to a section on the recording medium in the transport direction for each section.

3. An image forming apparatus comprising:

a first image holding member that is driven such that a surface thereof is circulated;

an image forming unit that forms an image on the first image holding member on the basis of image data;

a first transfer unit that transfers the image onto a recording medium which is transported in a set transport direction;

a pattern forming unit that forms patterns multiple times on the first image holding member;

a first detection unit that optically detects the patterns formed on the first image holding member by the pattern forming unit;

a second detection unit that optically detects the patterns transferred to the recording medium by the first transfer unit; and an adjustment unit that adjusts a length in the transport direction of the image on the basis of a time interval when the patterns are detected by the first detection unit and a time interval when the patterns are detected by the second detection unit.

4. The image forming apparatus according to claim 3, wherein the image forming unit includes a second image holding member that is driven such that a surface thereof is circulated;

a writing unit that writes a latent image onto the second image holding member on the basis of the image data;

a developing unit that develops the latent image so as to form an image; and a second transfer unit that transfers the image formed by the developing unit onto the first image holding member.

5. The image forming apparatus according to claim 4, wherein the adjustment unit adjusts a speed where the writing unit writes a latent image onto the second image holding member.

6. The image forming apparatus according to claim 3, wherein the pattern forming unit controls the image forming unit so as to form patterns on the first image holding member multiple times.

7. The image forming apparatus according to claim 4, wherein the pattern forming unit controls the image forming unit so as to form patterns on the first image holding member multiple times.

8. The image forming apparatus according to claim 5, wherein the pattern forming unit controls the image forming unit so as to form patterns on the first image holding member multiple times.

9. A non-transitory computer readable medium storing a program causing a computer which controls an image forming apparatus including a first image holding member that is driven such that a surface thereof is circulated, an image forming unit that forms an image on the first image holding member on the basis of image data, and a first transfer unit that transfers the image onto a recording medium which is transported in a set transport direction, to function as:

a pattern forming unit that forms patterns multiple times on the first image holding member;

a first detection unit that optically detects the patterns formed on the first image holding member by the pattern forming unit;

a second detection unit that optically detects the patterns transferred to the recording medium by the first transfer unit; and an adjustment unit that adjusts a length in the transport direction of the image on the basis of a time interval when the patterns are detected by the first detection unit and a time interval when the patterns are detected by the second detection unit.

10. An image forming method comprising:

forming patterns multiple times on an image holding member which is driven such that a surface thereof is circulated;

optically detecting the patterns formed on the image holding member;

optically detecting the patterns transferred from the image holding member to a recording medium which is transported in a set transport direction; and adjusting a length in the transport direction of an image transferred to the recording medium on the basis of a time interval when the patterns formed on the image holding member are detected and a time interval when the patterns transferred to the recording medium are detected.

* * * * *